US005273018A

United States Patent [19]

Suzuki

[11] Patent Number: 5,273,018

[45] Date of Patent: Dec. 28, 1993

[54] EVAPORATION FUEL CONTROL APPARATUS OF ENGINE

[75] Inventor: Harumi Suzuki, Shizuoka, Japan

[73] Assignee: Suzuki Motor Corporation, Shizuoka, Japan

[21] Appl. No.: 996,959

[22] Filed: Dec. 23, 1992

[30] Foreign Application Priority Data

Dec. 28, 1991 [JP] Japan ..... 3-360657
Jan. 30, 1992 [JP] Japan ..... 4-40283

[51] Int. Cl.[5] ..... F02M 37/04
[52] U.S. Cl. ..... 123/520; 123/516
[58] Field of Search ..... 123/520, 521, 519, 518, 123/516, 179.17

[56] References Cited

U.S. PATENT DOCUMENTS 4,809,667 3/1989 Uranashi ..... 123/520
4,977,881 12/1990 Abe ..... 123/520
5,150,686 9/1992 Okawa ..... 123/520

FOREIGN PATENT DOCUMENTS 0029761 2/1984 Japan ..... 123/520
61-226553 10/1986 Japan ..... 123/520
62-233466 10/1987 Japan .
0053054 3/1989 Japan ..... 123/520
1-211661 8/1989 Japan .
0005751 1/1990 Japan ..... 123/519
2-245461 10/1990 Japan .

*Primary Examiner*—Carl S. Miller
*Attorney, Agent, or Firm*—Flynn, Thiel, Boutell & Tanis

[57] ABSTRACT

An evaporation fuel control apparatus of the engine is provided for reducing the influence on the air fuel ratio control of an increase in the purge after the start of the engine in the situation where the evaporation fuel is in an extreme over-adsorbing state. A canister is arranged in the way of the air ventilation passage for communicating the intake passage of the engine and the fuel tank, the purge control valve is arranged in the way of the air ventilation passage between the canister and the intake passage, and the temperature sensor to detect the temperature state of the engine is provided. There is provided a control unit for starting the purge of the evaporation fuel adsorbed and held to the canister in the situation where the temperature that is detected by the temperature sensor exceeds the set temperature and for controlling the purge control valve so as to reduce the purge amount of the evaporation fuel until the elapsed time from the start of the purge elapses the set time.

3 Claims, 6 Drawing Sheets

Tw : ENGINE COOLING WATER TEMPERATURE (°C)

$Tw_1$ : SET TEMPERATURE (°C)

t : ELAPSED TIME (SEC) FROM PURGE ON AFTER THE ENGINE START $t_1$ : SET TIME (SEC)

DPRGB: FUNDAMENTAL PURGE MAP VALUE a : %

FIG. 3
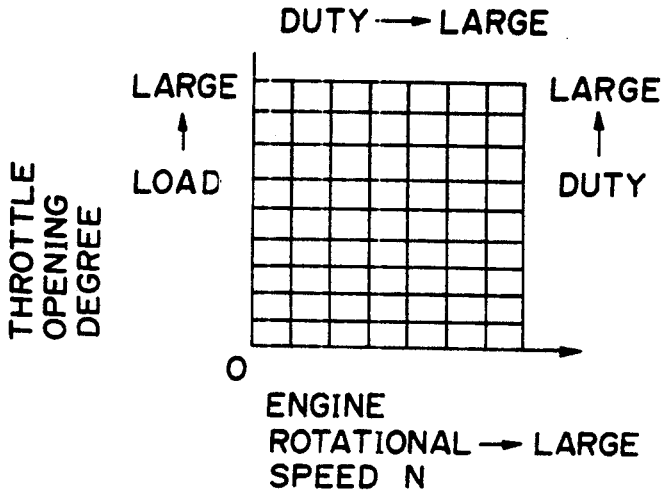
FIG. 4
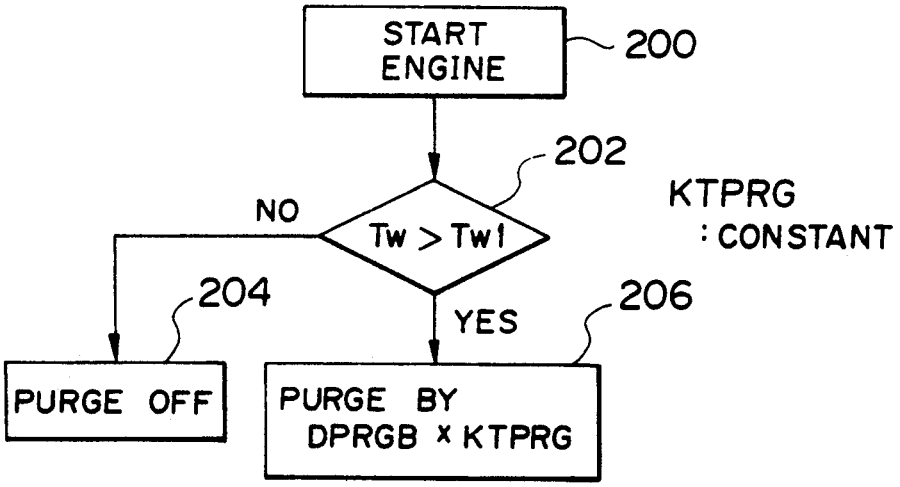
FIG. 5
| t (SEC) | 0 | 60 | 120 | 180 | 240 | 300 | 360 |
|---|---|---|---|---|---|---|---|
| KTPRG | 0.2 | 0.3 | 0.4 | 0.5 | 0.75 | 1.0 | 1.0 |

FIG. 8

TIME CORRECTION
COEFFICIENT (EXAMPLE)

| t (SEC) | 0 | 60 | 120 | 180 | 240 | 300 | 360 | | 600 |
|---|---|---|---|---|---|---|---|---|---|
| KTPRG | 0.2 | 0.3 | 0.4 | 0.5 | 0.75 | 1.0 | 1.0 | | 1.0 |

FIG. 9

INTAKE AIR TEMPERATURE
CORRECTION COEFFICIENT (EXAMPLE)

| THA(°C) | 20 | 30 | 40 | 50 | 60 | 70 | 80 | 90 | 100 |
|---|---|---|---|---|---|---|---|---|---|
| KTHAPRG | 1.0 | 1.0 | 1.0 | 1.5 | 2.0 | 2.0 | 2.0 | 2.0 | 2.0 |

EVAPORATION FUEL CONTROL APPARATUS OF ENGINE

FIELD OF THE INVENTION

The invention relates to an evaporation fuel control apparatus of an internal combustion engine and, more particularly, to an evaporation fuel control apparatus which prevents the air fuel ratio from becoming overdense after the start of the engine even when evaporation fuel in a canister is in an extreme over-adsorbed state, thereby avoiding harmful deterioration of an exhaust component.

BACKGROUND OF THE INVENTION

In an internal combustion engine which is installed in a vehicle or the like, there is provided an evaporation fuel control apparatus which prevents the emission of the evaporation fuel which is generated in a fuel tank or the like during stoppage of the engine. In the evaporation fuel control apparatus, a canister is arranged in the way of an air ventilation passage for communicating an intake passage of the engine and the fuel tank, and a purge control valve is arranged in the way of the air ventilation passage between the canister and the intake passage.

In the evaporation fuel control apparatus, the purge control valve is closed by a control unit when the engine is stopped, thereby allowing the evaporation fuel to be temporarily adsorbed and held in the canister. When the engine operates, the purge control valve is duty controlled, thereby purging (removing) the evaporation fuel adsorbed and held in the canister and feeding it to the intake passage.

Such evaporation fuel control apparatus are disclosed in JP-A-62-233466 or JP-A-1-211661.

According to the apparatus disclosed in JP-A-62-33466, a main purge control valve is provided in an air ventilation passage, a sub-purge control valve is provided in a bypass air ventilation passage to bypass the main purge control valve, and in order to prevent that an air fuel ratio becomes overdense or overlean at the start or stop of the purge, a permission or inhibition of the purge is discriminated from a stored air fuel ratio feedback coefficient and a presumed air fuel ratio feedback coefficient, thereby controlling a purge amount.

According to the apparatus disclosed in JP-A-1-211661, in order to prevent the air fuel ratio from becoming overdense in the first purge of the evaporation fuel after the fuel is fed into the fuel tank, a fuel feed amount to the engine is reduced at the time of the first purge of the evaporation fuel.

An evaporation fuel control apparatus also is disclosed in JP-A-2-245461. According to the apparatus disclosed, as the fuel concentration of purge gas (evaporation fuel) is high, the opening operating speed of a purge valve is reduced, thereby preventing the air fuel ratio from transiently becoming rich at the initial stage of the start of the purge.

Further, there is also known an evaporation fuel control apparatus in which in the situation where a cooling water temperature exceeds a set temperature at the start of the cooling of the engine, the evaporation fuel is purged in accordance with a duty map by a purge control valve which is duty controlled.

In the conventional evaporation fuel control apparatus of the engine, however, in the situation where the adsorbing state of the evaporation fuel to the canister is in the extreme over-adsorbing state (as a state in which it exceeds the over-adsorbing state) and the evaporation fuel has been further adsorbed to the canister, the evaporation fuel can be easily purged from the canister.

As mentioned above, in the situation where the canister is in the extreme over-adsorbing state, when the first purge is executed after the start of the engine, a purge amount increases since the evaporation fuel can be easily purged from the canister. In this situation, when the air fuel ratio control is attempted, the air fuel ratio cannot be controlled to a target value.

Therefore, at the time of the purge by the canister in the extreme over-adsorbing state after the start of the engine, there is a large influence on the air fuel ratio control. In particular, the air fuel ratio cannot be controlled to a target value, and the air fuel ratio becomes overdense. As a result, the harmful exhaust component is deteriorated due to the overdense air fuel ratio.

SUMMARY OF THE INVENTION

To overcome the above disadvantages, the invention is characterized in that a canister is provided in the way of an air ventilation passage for communicating an intake passage of the engine and a fuel tank, a purge control valve is interposed in the way of the air ventilation passage between the canister and the intake passage, and a temperature sensor to detect a temperature state of the engine is provided. There is provided control means for starting a purge of an evaporation fuel adsorbed and held to the canister in the situation wherein the temperature detected by the temperature sensor exceeds a set temperature and for controlling the purge control valve so as to reduce a purge amount of the evaporation fuel until an elapsed time from the start of the purge elapses a set time.

According to the invention, the purge of the evaporation fuel which has been adsorbed and held in the canister is started by the control means in the situation where the temperature which is detected by the temperature sensor exceeds the set temperature. The purge control valve is controlled by the control means so as to reduce the purge amount of the evaporation fuel until the elapsed time from the start of the purge elapses the set time. Due to this, the influence of an increase in purge amount (resulting from the evaporation fuel being easily purged from the canister when the purge is started after the start of the engine in the situation where the canister is in the extreme over-adsorbing state) on the air fuel ratio can be reduced.

In one embodiment of the invention, the control means executes a fundamental purge control after the start of the internal combustion engine when the purge valve is ON, a temperature of a cooling water is equal to or higher than a set cooling water temperature, and an intake air temperature is equal to or higher than a set intake air temperature. The control means controls the operation of the purge valve so as to gradually increase the evaporation fuel amount in accordance with a time state until the elapse of a predetermined time in the situation where the intake air temperature is lower than the set intake air temperature. Due to this, even in the situation where the evaporation fuel is in the extreme over-adsorbing state (as a state in which it exceeds the over-adsorbing state) and the evaporation fuel is further adsorbed to the canister, the influence on the air fuel ratio control by the purge of the evaporation fuel after the start of the internal combustion engine can be reduced, the overdense air fuel ratio can be prevented, and a deterioration of the exhaust harmful component can be prevented.

BRIEF DESCRIPTION OF THE DRAWINGS

An embodiment of the invention will now be described in detail on the basis of the drawings.

FIG. 3 is a diagram showing a fundamental purge map of an engine rotational speed versus a load.

FIG. 4 is a flowchart of a control in the second embodiment of the invention.

FIG. 5 is a diagram showing the relation of a constant for correction to an elapsed time in the second embodiment.

FIG. 8 is an explanatory diagram of a time correction coefficient which changes in accordance with a time state.

FIG. 9 is an explanatory diagram of an intake air temperature correction coefficient which changes in accordance with an intake air temperature.

DETAILED DESCRIPTION

Figure 1:
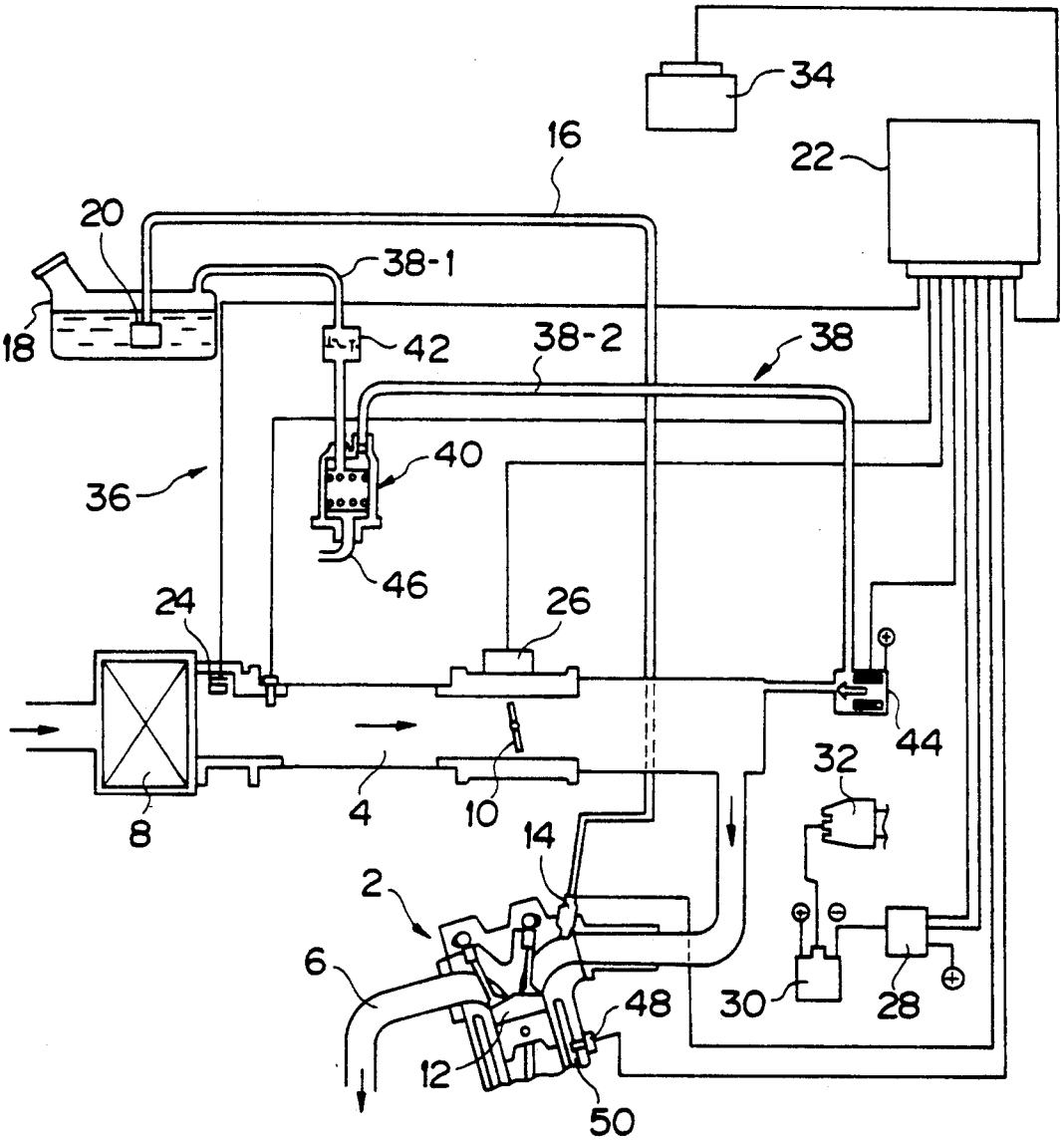
FIG. 1 is a schematic constructional diagram of an evaporation fuel control apparatus showing an embodiment of the invention.
Figure 2:
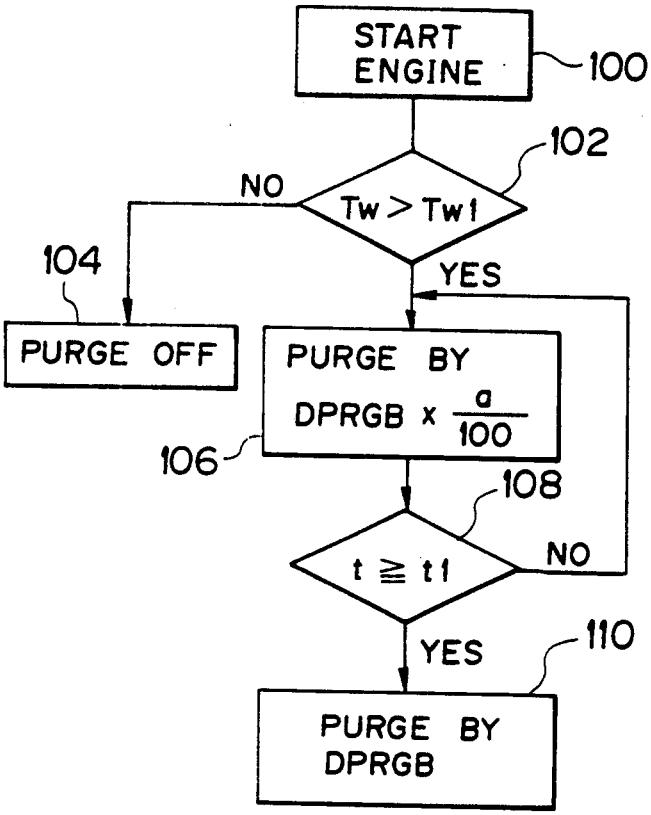
FIG. 2 is a flowchart of a control means of the first embodiment.

FIGS. 1 to 3 show the first embodiment of the invention. In FIG. 1, reference numeral 2 denotes an engine; 4 denotes an intake passage; and 6 denotes an exhaust passage. An air cleaner 8 is provided at one end of the intake passage 4 of the engine 2, and a throttle valve 10 is provided in intake passage 4. The other end of the intake passage 4 is communicated to a combustion chamber 12. The exhaust passage 6 has one end communicated with the combustion chamber 12 and the other end is opened to the atmosphere.

A fuel injection valve 14 is provided for the intake passage 4 of the engine 2 so as to be directed toward the combustion chamber 12. The fuel injection valve 14 is communicated with a fuel tank 18 by a fuel passage 16. The fuel in the fuel tank 18 is supplied to the fuel injection valve 14 through the fuel passage 16 by a fuel pump 20 and is spouted and fed into the combustion chamber 12.

The fuel injection valve 14 is connected to a computer control unit 22 as control means. An air flow meter 24 to detect an intake air amount, an opening degree sensor 26 to detect an opening degree of the throttle valve 10, an igniter 28 to detect a rotational speed of the engine, an air fuel ratio sensor (not shown), and the like are connected to the control unit 22 as operating state sensors for detecting the operating state of the internal combustion engine 2.

The control unit 22 drives and controls the fuel injection valve 14 by signals which are supplied from the sensors 24 to 28 and jets and feeds the fuel so as to obtain an air fuel ratio as a target value which is required by the engine 2, thereby controlling the air fuel ratio. Reference numeral 30 denotes an ignition coil; 32 denotes a distributor; and 34 denotes a control section for an automatic transmission.

An evaporation fuel control apparatus 36 to control the evaporation fuel which is generated in the fuel tank 18 has an air ventilation passage 38. On end of the passage 38 is communicated with the intake passage 4 on the downstream side of the throttle valve 10 of the engine 2 and the other end side is communicated with the fuel tank 18. A canister 40 is arranged in the way of the air ventilation passage 38. The air ventilation passage 38 comprises: a first air ventilation passage section 38-1 to communicate the fuel tank 18 and canister 40 and a second air ventilation passage section 38-2 to communicate the canister 40 and intake passage 4.

A check valve 42, which is constructed as a two-way valve, is arranged in the way of the first air ventilation passage section 38-1. A purge control valve 44 is arranged in the way of the second air ventilation passage section 38-2. The purge control valve 44 is connected to the control section 22 and is duty controlled. a new air passage 46 to introduce the new air is communicated with the canister 40.

In the evaporation fuel control apparatus 36, the purge control valve 44 is stopped by the control unit 22 when the engine 2 is stopped, thereby allowing the evaporation fuel to be temporarily adsorbed and held to the canister 40 by the first air ventilation passage section 38-1. When the engine 2 operates, the purge control valve 44 is duty controlled and the evaporation fuel adsorbed and held to the canister 40 is purged (removed) by the new air which is introduced via the new air passage 46. The purged evaporation fuel is fed to the intake passage 4 by the second air ventilation passage section 38-2.

The purge control valve 44 of the evaporation fuel control apparatus 36 is connected to the control unit 22. A temperature sensor 48 to detect a temperature state of the engine 2 is connected to the control unit 22. The temperature sensor 48 is attached so as to face a cooling water passage 50 of the engine 2 and detects a cooling water temperature $T_w$.

The control unit 22 receives a detection signal of the cooling water temperature $T_w$ from the temperature sensor 48 and controls the purge control valve 44 so as to start the purge of the evaporation fuel adsorbed and held to the canister 40 in the situation where the cooling water temperature $T_w$ which is detected by the temperature sensor 48 exceeds a set temperature $T_{w1}$ and to reduce a purge amount of the evaporation fuel until an elapsed time t from the start of the purge elapses, or surpasses, a set time $t_1$.

In the first embodiment of the invention, the purge control valve 44 is duty controlled by the control unit 22 in a manner that in the situation where the cooling water temperature $T_w$ exceeds the set temperature $T_{w1}$, the purge of the evaporation fuel adsorbed and held to the canister 40 is started, and until the elapsed time t from the start of the purge elapses the set time $t_1$, the purge amount of the evaporation fuel is reduced by a value (DPRGB×a/100) which is obtained by multiplying a percentage value a (%) for correction to a fundamental purge map value DPRGB which is read out from a fundamental purge map shown in FIG. 3 stored in the control unit 22.

The operation will now be described.

When the engine 2 is stopped, the control unit 22 closes the second air ventilation passage 38-2 without making the purge control valve 44 operative. Due to this, the evaporation fuel in the fuel tank 18 is adsorbed and held to the canister 40 via the first passage 38-1.

As shown in FIG. 2, when the engine 2 is started (step 100), the control section 22 discriminates (step 102) to see if the cooling water temperature $T_w$ exceeds the set temperature $T_{w1}$ ($T_w > T_{w1}$) or not.

When the cooling water temperature $t_w$ is equal to or less than the set temperature $T_{w1}$ (NO in step 102), by stopping the purge control valve 44, the second air ventilation passage 38-2 is closed and the purge is set to OFF (step 104).

When the cooling water temperature $T_w$ exceeds the set temperature $T_{w1}$ (YES in step 102), the purge is set to ON (step 106) and started. Thus, the purge control valve 44 is duty controlled and the purge of the evaporation fuel via the second air ventilation passage section 38-2 is started.

In this instance, the purge control valve 44 is duty controlled by the value (DPRGB×a/100) which is obtained by multiplying the percentage value a (%) for correction to the fundamental purge map value DPRGB which is read out by control unit 22 from the stored fundamental purge map of FIG. 3, thereby reducing the purge amount of the evaporation fuel.

After the start of the purge of the evaporation fuel by the ON (step 106) of the purge, a check is made (step 108) to see if the elapsed time t from the start of the purge is equal to or longer than the set time $t_1$ ($t \geqq t_1$) or not.

When the elapsed time t from the start of the purge is shorter than the set time $t_1$ and doesn't elapse the set time $t_1$ (NO in step 108), step 106 is continued.

When the elapsed time $t_1$ from the start of the purge is equal to or longer than the set time $t_1$ and elapses the set time $t_1$ (YES in step 108), the reduction of the purge amount of the evaporation fuel in step 106 is stopped. The purge control valve 44 is duty controlled by the fundamental purge map value DPRGB which is read out from the fundamental purge map in FIG. 3 and the ordinary purge of the evaporation fuel is executed.

As mentioned above, the control unit 22 duty controls the purge control valve 44 in a manner such that in the situation where the engine 2 is started and the cooling water temperature $T_w$ which is detected by the temperature sensor 48 exceeds the set temperature $T_{w1}$, the purge of the evaporation fuel adsorbed and held to the canister 40 is started, and until the elapsed time t from the start of the purge elapses the set time $t_1$, the purge amount of the evaporation fuel is reduced by the value (DPRGB×a/100) which is obtained by multiplying the percentage value a (%) for correction to the fundamental purge map value DPRGB which is read out from the fundamental purge map shown in FIG. 3.

Consequently, even in the situation where the canister 40 is in the extreme over-adsorbing state, the influence of an increase in purge amount (resulting from the evaporation fuel being easily purged from the canister 40 at the time of the first purge after the start of the engine 2) on the air fuel ratio can be reduced.

As mentioned above, at the time of the purge after the start of the engine 2 with the canister 40 in the extreme over-adsorbing state, by reducing the purge amount, the influence on the air fuel ratio control can be reduced. Therefore, the air fuel ratio can be controlled to a target value, the overdense air fuel ratio can be prevented, and the deterioration of the exhaust harmful component can be prevented since it is prevented that the air fuel ratio becomes overdense.

FIGS. 4 and 5 show the second embodiment of the invention. In the second embodiment, since the construction of the engine 2, evaporation fuel control apparatus 36, and the like is similar to that in the first embodiment shown in FIG. 1, a detailed description of the construction is omitted.

According to the evaporation fuel control apparatus 36 of the second embodiment, the purge control valve 44 is duty controlled by the control unit 22 in a manner that when the cooling water temperature $T_w$ exceeds the set temperature $T_{w1}$, the purge of the evaporation fuel adsorbed and held to the canister 40 is started, and until the elapsed time t from the start of the purge elapses the set time $t_1$, the purge amount of the evaporation fuel is reduced by the value (DPRGB×KTPRG) which is obtained by multiplying a constant KTPRG for correction (i.e. the percentage value for correction) such that it is gradually increased and finally becomes "1" for the elapsed time t shown in FIG. 5 to the fundamental purge map value DPRGB which is read out from the fundamental purge map shown in FIG. 3.

The operation will now be described.

When the engine 2 is stopped, the control unit 22 closes the second air ventilation passage 38-2 without making the purge control valve 44 operative. due to this, the evaporation fuel in the fuel tank 18 is adsorbed and held to the canister 40 via the first air ventilation passage 38-1.

As shown in FIG. 4, when the engine 2 is started (step 200), the control unit 22 discriminates (step 202) whether the cooling water temperature $T_w$ exceeds the set temperature $T_{w1}$ ($T_w > T_{w1}$) or not.

When the cooling water temperature $T_w$ is equal to or lower than the set temperature $T_{w1}$ (NO in step 202), by stopping the purge control valve 44, the second air ventilation passage 38-2 is closed and the purge is set to OFF (step 204).

When the cooling water temperature $T_w$ exceeds the set temperature $T_{w1}$ (YES in step 202), the purge is set to ON (step 206) and started. Due to this, the purge control valve 44 is duty controlled and the purge of the evaporation fuel via the second air ventilation passage section 38-2 is started.

In this instance, the purge control valve 44 is duty controlled by the value (DPRGB×KTPRG) which is obtained by multiplying the constant KTPRG for correction such that it is gradually increased and finally becomes "1" for the elapsed time t shown in FIG. 5 to the fundamental purge map value DPRGB that is read out from the fundamental purge map of FIG. 3, thereby reducing the purge amount of the evaporation fuel.

A reduction ratio of the purge amount of the evaporation fuel due to ON of the purge (step 206) is gradually decreased as the elapsed time t from the start of the purge approaches the set time $t_1$. Thus, the purge amount can be gradually increased.

When the elapsed time t from the start of the purge is equal to or longer than the set time $t_1$ and elapses the set time $t_1$, the constant KTPRG for correction is gradually increased for the elapsed time t and finally becomes "1" as shown in FIG. 5. Therefore, the decrease in purge amount of the evaporation fuel in step 206 is stopped and the purge control valve 44 is duty controlled by the fundamental purge map value DPRGB which is read out from the fundamental purge map in FIG. 3, thereby executing the ordinary purge of the evaporation fuel.

According to the second embodiment as mentioned above, the control unit 22 duty controls the purge control valve 44 in a manner such that in the case where the engine 2 is started and the cooling water temperature $T_w$ which is detected by the temperature sensor 48 exceeds the set temperature $T_{w1}$, the purge of the evaporation fuel adsorbed and held to the canister 40 is started, and until the elapsed time t from the start of the purge elapses the set time $t_1$, the purge amount of the evaporation fuel is reduced by the value (DPRGB×KTPRG) which is obtained by multiplying the constant KTPRG for correction such that it is gradually increased and finally becomes "1" for the elapsed time t shown in FIG. 5 to the fundamental purge map value DPRGB that is read out from the fundamental purge map shown in FIG. 3.

Therefore, even in the case where the canister 40 is in the extreme over-adsorbing state, at the time of the first purge after the start of the engine 2, the influence of an increase in purge amount (resulting from the evaporation fuel being easily purged from the canister 40) on the air fuel ratio can be reduced. The purge amount is gradually increased and can be set to the ordinary purge amount.

As mentioned above, at the time of the purge after the start of the engine 2 with the canister 40 in the extreme over-adsorbing state, by reducing the purge amount, the influence on the air fuel ratio control can be reduced. The purge amount is gradually increased and can be set to the ordinary purge amount. Therefore, a large fluctuation of the purge amount is avoided and the influence on the air fuel ratio control can be further reduced. Consequently, the air fuel ratio can be controlled to the target value, the fluctuation in the air fuel ratio is further suppressed, the air fuel ratio can be smoothly controlled to the target value, and the overdense air fuel ratio can be prevented. The deterioration of the exhaust harmful component can be prevented because it is prevented that the air fuel ratio becomes overdense.

Figure 6:
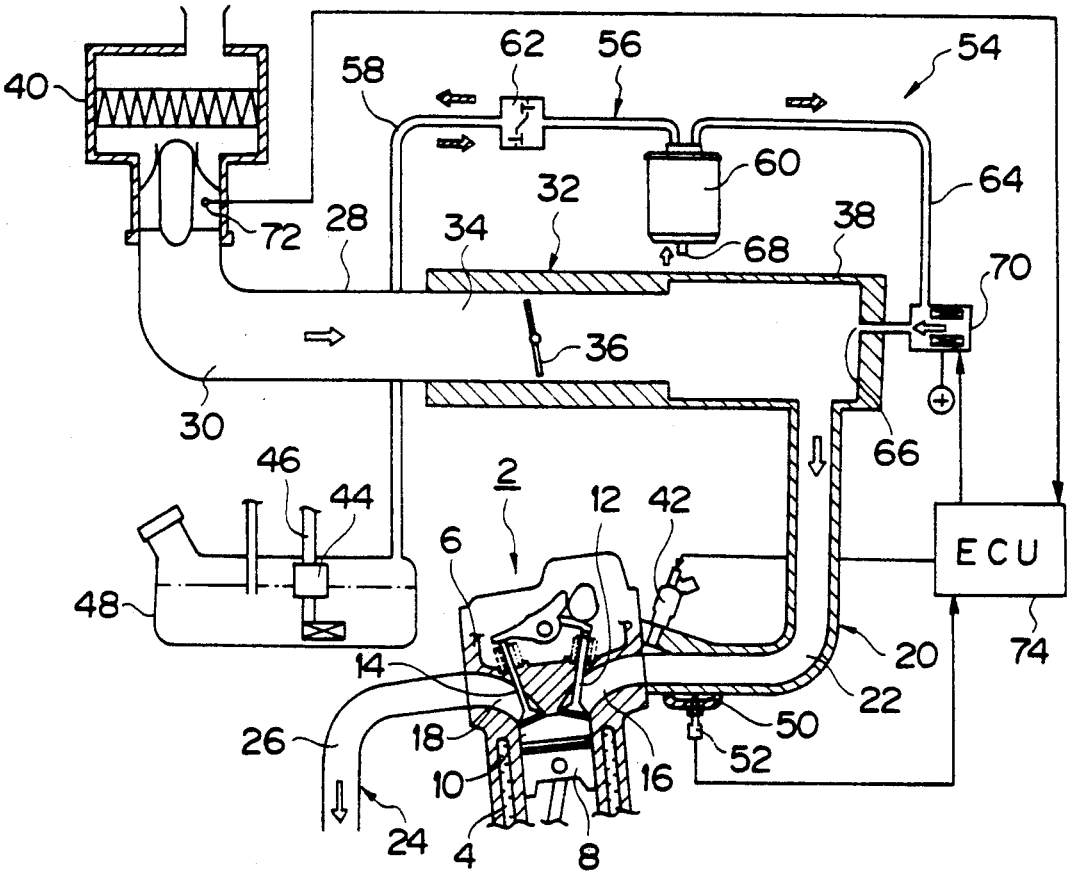
FIG. 6 is a system constructional diagram of an evaporation fuel control apparatus.

FIGS. 6 to 9 show a further embodiment of the invention. In FIG. 6, reference numeral 2 denotes an internal combustion engine which is installed in a vehicle (not shown); 4 a cylinder block; 6 a cylinder head; 8 a piston; 10 a combustion chamber ; 12 an intake valve; 14 an exhaust valve; 16 an intake port; 18 an exhaust port; 20 an intake manifold; 22 a manifold intake passage; 24 an exhaust manifold; 26 a manifold exhaust passage; 28 an intake pipe; 30 a pipe intake passage; 32 a throttle body; 34 a body intake passage; 36 an intake throttle valve; and 38 a surge tank.

An air cleaner 40 is provided at the upstream end of the intake pipe 28. The downstream end of the pipe intake passage 30 is communicated with the body intake passage 34 of the throttle body 32 having the intake throttle valve 36. The body intake passage 34 of the throttle body 32 is communicated with the manifold intake passage 22 of the intake manifold 20. The downstream end of the manifold intake passage 22 is communicated with the combustion chamber 10 of the internal combustion engine 2 through the intake port 16 and intake valve 12. The combustion chamber 10 is communicated With the manifold exhaust passage 26 through the exhaust valve 14 and exhaust port 18.

A fuel injection valve 42 is attached to the intake manifold 20 so as to be directed in the direction of the combustion chamber 10. The fuel in the fuel tank 48 is fed via a fuel feeding pipe 46 by the driving of a fuel pump 44 to the fuel injection valve 42.

A cooling water passage 50 is formed in the intake manifold 20. A water temperature sensor 52 to detect a temperature of cooling water in the cooling water passage 50 is attached to the intake manifold 20.

An air ventilation passage 56 of an evaporation fuel control apparatus 54 is provided between the fuel tank 48 and the surge tank 38 of the intake system.

One end of an evaporation passage 58 comprising a part of the air ventilation passage 56 is communicated to the fuel tank 48 and the other end is opened and communicated to the upper portion of a canister 60. A two-way valve 62 is arranged in the way of the evaporation passage 58.

One end of a purge passage 64 comprising a part of the air ventilation passage 56 is opened to the upper portion of the canister 60 in parallel with the purge passage 58 and the other end is communicated with a purge port 66 of the surge tank 38 on the downstream side of the intake throttle valve 36.

The canister 60 encloses an adsorbent, such as an activated carbon or the like, to adsorb and hold the evaporation fuel from the fuel tank 48 side. The evaporation fuel which has been adsorbed and held to the adsorbent is purged by introducing the new air via an atmosphere introducing port 68 in the lower portion in accordance with the operating state of the internal combustion engine 2, thereby allowing the evaporation fuel to flow to the purge passage 64 side.

A purge valve (VSV) 70 is interposed in the way of the purge passage 64. The purge valve 70 communicates and shuts off the purge passage 64 and controls the evaporation fuel amount from the canister 60.

An intake temperature sensor 72 to detect a temperature of intake air is arranged on the pipe intake passage 30 on the downstream side of the air cleaner 40.

The fuel injection valve 42, water temperature sensor 52, purge valve 70, and intake temperature sensor 72 are connected to control means (engine control unit ECU) 74.

In the situation after the start of the internal combustion engine 2 when the purge valve 70 is ON, the cooling water temperature is equal to or higher than the set cooling water temperature, and the intake air temperature is equal to or higher than the set intake air temperature, the control means 74 executes a fundamental purge control according to a stored map (not shown). The control means 74 also controls the operation of the purge valve 70 so as to gradually increase a purge amount as an evaporation fuel amount in accordance with the time state until the elapse of a predetermined time in the situation where the intake air temperature is lower than the set intake air temperature.

A time correction coefficient KTPRG which changes in accordance with the time state as shown in FIG. 8 and an intake air temperature correction coefficient KTHAPRG which changes in accordance with the intake air temperature state as shown in FIG. 9 have been stored in a program of the control means 74.

Figure 7:
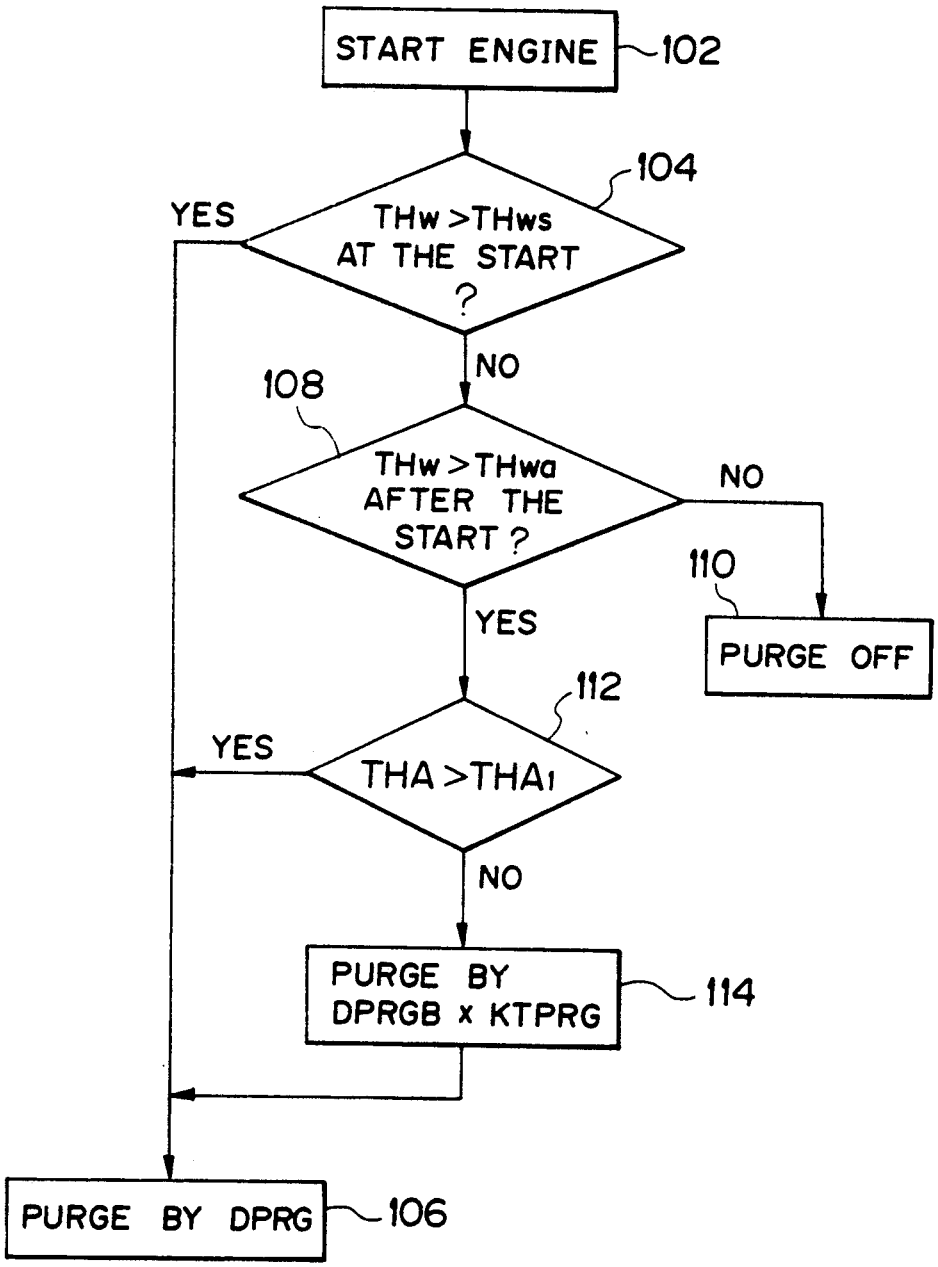
FIG. 7 is a flowchart of an evaporation fuel control method.

The operation of the embodiment will now be described on the basis of a flowchart of FIG. 7.

In the program of the control means 74, when the internal combustion engine 2 is started and the purge valve 70 is set to ON (step 102), a check is first made to see if the relation between a cooling water temperature $TH_w$ after the start of the engine and a set cooling water temperature $TH_{ws}$ (for example, 70° C.) at the start of the engine satisfies $TH_w > TH_{ws}$ or not (step 104.

If YES in step 104, since the cooling water temperature is relatively high, the purge is executed by a final purge amount DPRG (step 106).

The final purge amount DPRG is obtained by multiplying a correction coefficient $\alpha$ to a fundamental purge amount DPRGB which is determined by a map provided in the program of the control means 74. That is, $DPRG = DPRGB \times \alpha$.

The correction coefficient $\alpha$ is, for instance, a coefficient which changes in accordance with a coefficient such as intake air temperature correction coefficient KTHAPRG shown in FIG. 9, fuel temperature correction coefficient (not shown), or the like.

If NO in step 104, a check is made to see if the cooling water temperature $TH_w$ after the start of the engine is larger than a set cooling water temperature $TH_{wa}$ (for example, 40° C.) after the start of the engine or not (step 108).

Therefore, the relation between the set temperature at the start of the engine and the set temperature after the start of the engine satisfies $TH_{ws} > TH_{wa}$.

If NO in step 108, the purge valve 70 is set to OFF and the purge is stopped (step 110).

If YES in step 108, a check is made to see if the relation between an intake air temperature THA and a set intake air temperature $THA_1$ (e.g., 35° C.) satisfies $THA < THA_1$ or not (step 112).

If YES in step 112, the engine is in a warming-up state after the start of the engine and the purge is executed by the final purge amount DPRG (step 106).

On the other hand, if NO in step 112, the engine is in a cooling state after the start of the engine and the time correction coefficient KTPRG in FIG. 8 is multiplied to the fundamental purge amount DPRGB and the purge is executed. That is, the purge is executed by $DPRGB \times KTPRG$ until a predetermined time (t seconds: for example, 600 seconds) elapses (step 114). In this instance, until the elapse of a predetermined time (t seconds, e.g., 600 seconds), the purge amount is gradually increased in accordance with the time state by the time correction coefficient of FIG. 8, and after the elapse of the predetermined time, the purge is performed by the final purge amount DPRG (step 106).

Thus, even in the case where the evaporation fuel of the canister 60 is in the over-adsorbing state, the purge amount after the start of the internal combustion engine 2 can be finely controlled, so that the influence on the air fuel ratio control is reduced and the overdense air fuel ratio is prevented. Thus, the deterioration of the exhaust harmful component can be prevented.

Since the purge control after the start of the internal combustion engine 2 in the cooling state and the purge control after the start of the internal combustion engine 2 in the warming-up state can be individually executed, the purge amount can be increased without deteriorating the exhaust harmful component and the adsorbing performance of the evaporation fuel of the canister 60 can be improved.

As will be obviously understood from the above detailed description, according to the invention, there is provided control means for executing the fundamental purge control in the situation where after the start of the internal combustion engine when the purge valve is ON, the cooling water temperature is equal to or higher than the set cooling water temperature, and the intake air temperature is equal to or higher than the set intake air temperature and for controlling the operation of the purge valve so as to gradually increase the evaporation fuel amount in accordance with the time state until the elapse of a predetermined time in the case where the intake air temperature is lower than the set intake air temperature. Therefore, even in the situation where the evaporation fuel is in the extreme over-adsorbing state (as a state in which it exceeds the over-adsorbing state) and the evaporation fuel has further been adsorbed to the canister, the influence on the air fuel ratio control due to the purge after the start of the internal combustion engine is reduced, the overdense air fuel ratio is prevented, and the deterioration of the exhaust harmful component can be prevented.

The embodiments of the invention in which an exclusive property or privilege is claimed are defined as follows:

1. In an evaporation fuel control apparatus having a canister disposed in line with an air ventilation passage for communicating the inside of a fuel tank and an intake passage of an intake system of an internal combustion engine, said canister being used for adsorbing and holding evaporated fuel generated in said fuel tank when the internal combustion engine is non-operative and for purging to said intake passage said adsorbed and held evaporated fuel by introducing new air during operation of the internal combustion engine, and a purge valve disposed in line with the air ventilation passage for controlling an amount of evaporated fuel supplied from the canister to the intake passage in accordance with an operating state of the internal combustion engine, the improvement comprising:

control means for executing a fundamental purge control operation after the start of the internal combustion engine when predetermined operating conditions are present, said conditions including the purge valve is activated, a temperature of a cooling water is equal to or higher than a set cooling water temperature, and an intake air temperature is equal to or higher than a set intake air temperature, and for controlling the operation of the purge valve when said intake air temperature is lower than said set intake air temperature so as to gradually increase the amount of evaporated fuel purged from said canister until the lapse of a predetermined amount of time.

2. An evaporation fuel control apparatus for communicating evaporated fuel discharged from a fuel tank to an intake passage of an engine along an air ventilation passage, said evaporated fuel control apparatus comprising:

a canister disposed between said fuel tank and said intake passage in line with said air ventilation passage for adsorbing and holding said evaporated fuel discharged from said fuel tank;

a purge control valve means interposed between said canister and said intake passage in line with said air ventilation passage for permitting said evaporated fuel to pass from said canister to said intake passage of said engine;

a temperature sensor for detecting a temperature state of said engine;

control means for starting a purge of said evaporated fuel adsorbed and held in said canister when said temperature state of said engine exceeds a set temperature, and for controlling said purge control valve means to reduce the amount of said evaporated fuel being purged from said canister until an elapsed time from start of said purge surpasses a set time, said purge amount of said evaporated fuel adsorbed and held in said canister being reduced by a value obtained by multiplying together a percentage value for correction and a fundamental purge map value derived from a fundamental purge map.

3. The apparatus of claim 2, wherein said percentage value for correction is gradually increased from a starting value to a value of "1" during said elapsed time.

* * * * *